US007540629B2

(12) United States Patent
Steinberg

(10) Patent No.: US 7,540,629 B2
(45) Date of Patent: Jun. 2, 2009

(54) MODULAR FIXTURE AND SPORTS LIGHTING SYSTEM

(75) Inventor: Gary A. Steinberg, Flat Rock, NC (US)

(73) Assignee: General Electric Company, Schenectady, NY (US)

( * ) Notice: Subject to any disclaimer, the term of this patent is extended or adjusted under 35 U.S.C. 154(b) by 323 days.

(21) Appl. No.: 11/023,757

(22) Filed: Dec. 28, 2004

(65) Prior Publication Data

US 2006/0139659 A1 Jun. 29, 2006

(51) Int. Cl.
*F21V 21/00* (2006.01)
*F21V 33/00* (2006.01)

(52) U.S. Cl. ..... 362/234; 362/249; 362/252; 362/298

(58) Field of Classification Search ..... 362/20, 362/249, 252, 431, 297, 298, 300, 234
See application file for complete search history.

(56) References Cited

U.S. PATENT DOCUMENTS 4,450,507 A * 5/1984 Gordin ..... 362/463
4,547,841 A 10/1985 Quiogue
4,725,934 A 2/1988 Gordin
4,816,974 A 3/1989 Gordin
4,864,476 A 9/1989 Lemons et al.
4,947,303 A 8/1990 Gordin et al.
5,075,828 A 12/1991 Gordin et al.
5,134,550 A * 7/1992 Young ..... 362/560
5,211,473 A 5/1993 Gordin et al.
5,274,534 A 12/1993 Armstrong
5,313,379 A 5/1994 Lemons et al.
5,337,221 A 8/1994 Gordin et al.
5,343,374 A 8/1994 Gordin et al.
5,402,327 A 3/1995 Gordin et al.
5,519,590 A 5/1996 Crookham et al.
5,569,983 A * 10/1996 McGuire et al. ..... 315/297
5,582,479 A 12/1996 Thomas et al.
5,595,440 A 1/1997 Gordin et al.
5,645,344 A 7/1997 Wijbenga
5,647,661 A 7/1997 Gordin
5,791,768 A 8/1998 Splane, Jr.
5,800,048 A 9/1998 Gordin (Continued)

FOREIGN PATENT DOCUMENTS

EP 0643258 A1 3/1995

(Continued)

*Primary Examiner*—Thomas M Sember
(74) *Attorney, Agent, or Firm*—Fay Sharpe LLP

(57) ABSTRACT

A light fixture includes a lamp engine, an electronic module connected to the lamp engine and a photometric module mounted to the light engine. The electronic module is connected to the light source and an associated power source for providing power to the light source. The photometric module mounts to the light engine and creates a beam pattern that illuminates a substantial portion of an entire associated subject area. The method of illuminating a large area includes determining a subject area to be illuminated by a plurality of light sources and determining a desired lighting criteria for the subject area. A first light source is provided and light emitted from the first light source is directed to illuminate the subject area. Additional light sources are provided and directed to provide additional light to illuminate the same portion of the subject area until the desired lighting criteria are met.

10 Claims, 12 Drawing Sheets

U.S. PATENT DOCUMENTS 5,906,425 A 5/1999 Gordin et al.
5,924,788 A 7/1999 Parkyn
5,924,789 A * 7/1999 Thornton
5,938,317 A * 8/1999 Thornton
6,036,338 A * 3/2000 Gordin
6,068,388 A 5/2000 Walker et al.
6,111,359 A * 8/2000 Work et al.
6,190,023 B1 2/2001 Leadford et al.
6,203,176 B1 * 3/2001 Gordin
6,220,726 B1 * 4/2001 Gordin
6,460,284 B1 * 10/2002 Rabo ..... 43/3

FOREIGN PATENT DOCUMENTS

EP 0643258 B1 7/1998

* cited by examiner

MODULAR FIXTURE AND SPORTS LIGHTING SYSTEM

BACKGROUND OF THE INVENTION

This invention relates to illumination devices. More particularly, the invention relates to illuminating a large surface area or playing surface such as a sports or recreation field. The invention is also amenable to other applications including lighting parking lots, as well as other large areas including indoor areas.

Existing sports lighting installations normally comprise several poles and a multiplicity of similar fixtures that are typically the same wattage and model with different photometric characteristics. The fixtures are mounted on poles with cross-arms and individually aimed in such a way that the various photometric patterns fill in regions of the lighted area to meet the desired uniformity and light levels. In some applications this requires measuring the lighting results and pointing the fixtures at the time of installation to compensate for variations in the individual fixture photometry, photometric axis, and the inaccuracies of fixture pointing on the mounting arm and pole.

A typical parks and recreation sports field might incorporate four to eight poles and approximately 50-60 fixtures. The fixtures typically comprise several general purpose flood lights with National Electrical Manufacturers Association ("NEMA") types describing the photometric characteristics of the fixtures. NEMA types 3×3 (med-narrow), 4×4, 5×5, and 6×6 (wide) would normally be used. Each fixture is installed on a cross-arm on a pole and aimed in both azimuth and elevation according to a design plan to create a composite field lighting pattern that meets uniformity and light level specifications. In general, each fixture lights a limited portion of the entire field that is substantially less than the area of the entire field. Lamp failures in individual fixtures cause local dimmed regions on the field and uniformity loss. Also, portions of the fixtures cannot be turned off to conserve energy without creating dimmed regions on the field. Furthermore, each fixture must be pointed or aimed individually at the time of installation to achieve the intended lighting result. This, of course, becomes a time consuming and expensive task.

FIG. 1 depicts a known lighting system where a plurality of floodlights A mount to a cross-arm B of a pole C. The floodlights generate generally elliptical distribution patterns D that illuminate separate portions of a playing surface E. Light poles and fixtures are added as necessary to illuminate the playing surface to the desired light level and uniformity. In general, the economics of purchase and operating costs drive the design to use the minimum number of fixtures necessary to meet the light level and uniformity requirements. This substantially limits or precludes redundancy in light coverage on the field and if one fixture fails, a region of low light level results in the area that was illuminated by the light emitted from the failed fixture.

Accordingly, it is desirable to provide a lighting system and method where if one fixture fails, the average light level over the entire playing surface or field is reduced, but the uniformity of the light on the field remains substantially the same. It is also desirable to provide a lighting system and method that reduces the complexity of installation of the system by greatly reducing or eliminating fixture aiming.

BRIEF SUMMARY OF THE INVENTION

A modular light fixture primarily for use in sports lighting applications, but with features that are potentially useful in general outdoor area and indoor lighting applications, includes a light engine serving to provide a generally converging beam of light onto which an application specific photometric module is attached. The photometric module distributes light so that a photometric pattern is created that covers the entire playing surface. To achieve the desired light levels, multiple duplicate fixtures using identical engines can be used. Application specific photometric modules that are typically designed as right hand and left hand modules are pointed in the same general direction are used in superposition. This allows the lighting design for specific applications to be standardized. Modular construction facilitates assembly and lighting system installation. Additionally, the fixture can be configured to provide the photometric characteristics of the typical NEMA classifications used currently in most sports lighting installations.

A method of providing redundancy when illuminating a large area such as a sports/recreation field or playing surface is also provided. The method includes determining a subject area to be illuminated by a plurality of light sources and determining a desired lighting criteria for the subject area. A first light source is provided and light emitted from the first light source is directed to illuminate the subject area. Additional light sources are provided to illuminate at least a substantial portion of the subject area until the desired lighting criteria are met.

DETAILED DESCRIPTION OF THE INVENTION

Figure 2:
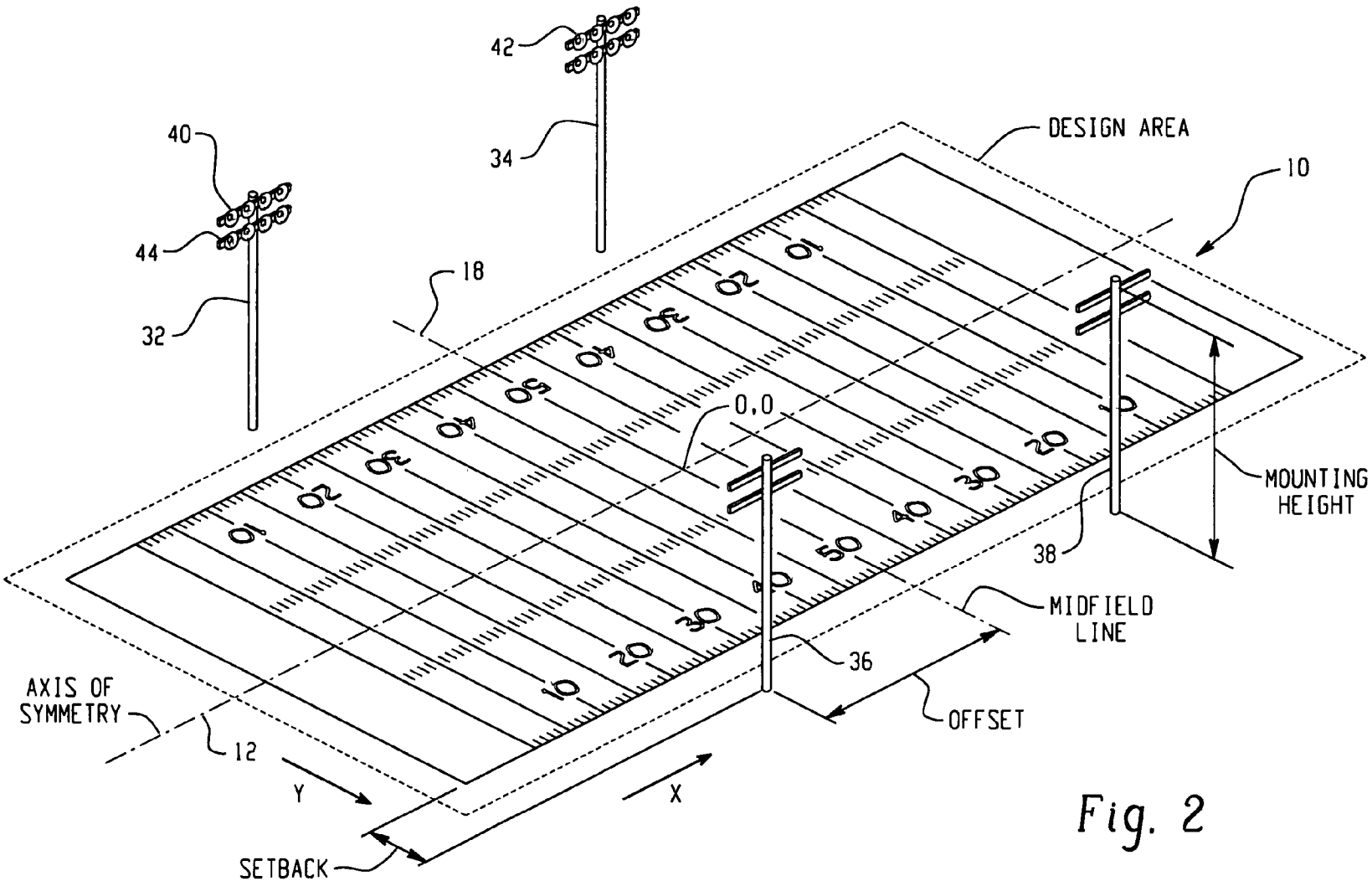
FIG. 2 is a schematic of a sports/recreational field to be lighted by the new lighting system of the present invention.

With reference to FIG. 2, a subject area 10 is illuminated by a plurality of lights. For the sake of brevity and understanding, the subject area 10 in this portion of the description is a football field, however it is to be understood that the subject area could be any recreation field or large area including, without limitation, a baseball field, a softball field, a soccer field, a recreation field, an arena floor, a tennis court, an exercise floor, a gymnasium floor, or a parking lot.

Facilities, such as playing fields, are designed according to certain illumination criteria. The lighting level illumination criteria are usually measured in foot candles ("fc"). As just one example, class II football requires 50 fc horizontal and 40 fc vertical. The classes and the lighting level are well known in the art and need not be described in further detail.

In addition to the lighting level, another illumination criterion is the uniformity of lighting throughout the playing area. Uniformity generally refers to the evenness of the lighting and is expressed as a ratio of the maximum to minimum foot candles on the subject area or as a ratio of average to minimum foot candles on the subject area. Objects traveling through the air, such as a football, will appear to change speeds as it passes from dark to light areas in non-uniform light, thus making it difficult to follow. Accordingly, lighting designers strive to achieve uniformity over the playing area.

To design proper lighting for the football field in FIG. 2, the size of the playing area is determined. The playing area will usually include additional area outside the field boundaries, e.g. sidelines, player's benches, dugouts, etc. A map of the field is then derived, with x and y coordinates designating specific positions on the field. The desired illuminance, i.e., number of foot candles, to illuminate each coordinate is designated on the map as a z coordinate.

Figure 3:
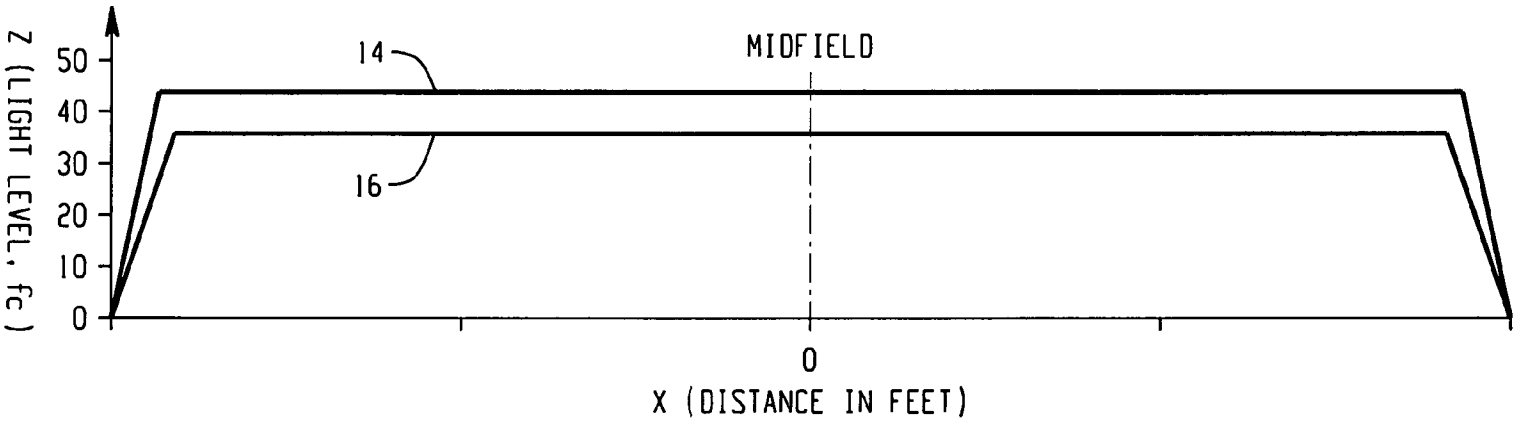
FIG. 3 is a graph depicting the lighting level at certain locations along a cross section of the sports/recreational field of FIG. 2.
Figure 4:
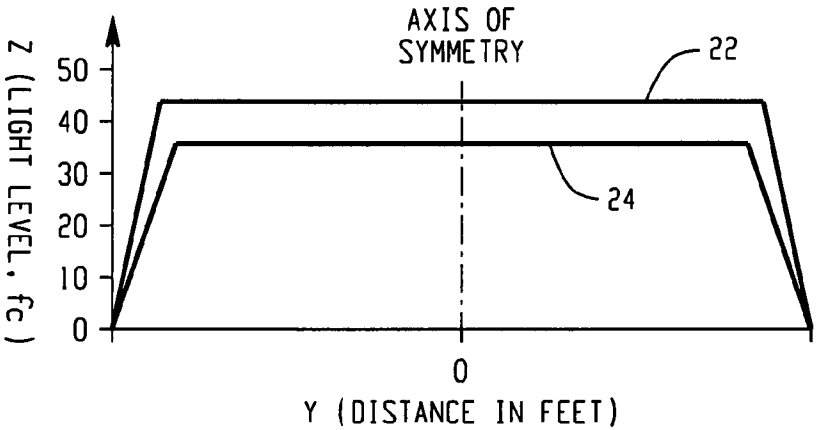
FIG. 4 is a graph depicting the lighting level at certain locations along another cross section of the field of FIG. 2.

The three dimensions x, y, and z are plotted to derive a map representative of the lighting level characteristics of the field, sort of a topographic map. A cross section of the field can be taken an infinite number of times along the x and y axes to derive graphs similar to FIGS. 3 and 4. With reference to FIG. 3, a cross section of the field 10 is taken along a line of symmetry 12 (FIG. 2) that extends in the x-axis direction. The x-axis refers to the length of the field including the additional area to be illuminated. The z-axis refers to the desired illuminance in foot candles. A line 14 in the z-axis refers to the desired horizontal foot candles and a line 16 refers to the desired vertical foot candles. Of course it will be appreciated by one skilled in the art that these graphical representations are only for purposes of explaining the invention and the particular numeric values and/or relative differences in values of a particular field. With reference to FIG. 4, a cross section of the field 10 is taken along a midfield line 18 (FIG. 2.). The y-axis refers to the width of the field including the additional area that is to be illuminated. The z-axis refers to the desired illumination in foot candles, where a line 22 refers to the desired horizontal foot candles and a line 24 refers to the desired vertical foot candles. The taper of the lines 14, 16, 22 and 24 is due to the fact that a hard boundary is physically unrealizable because a beam pattern cannot terminate abruptly.

Figure 1:
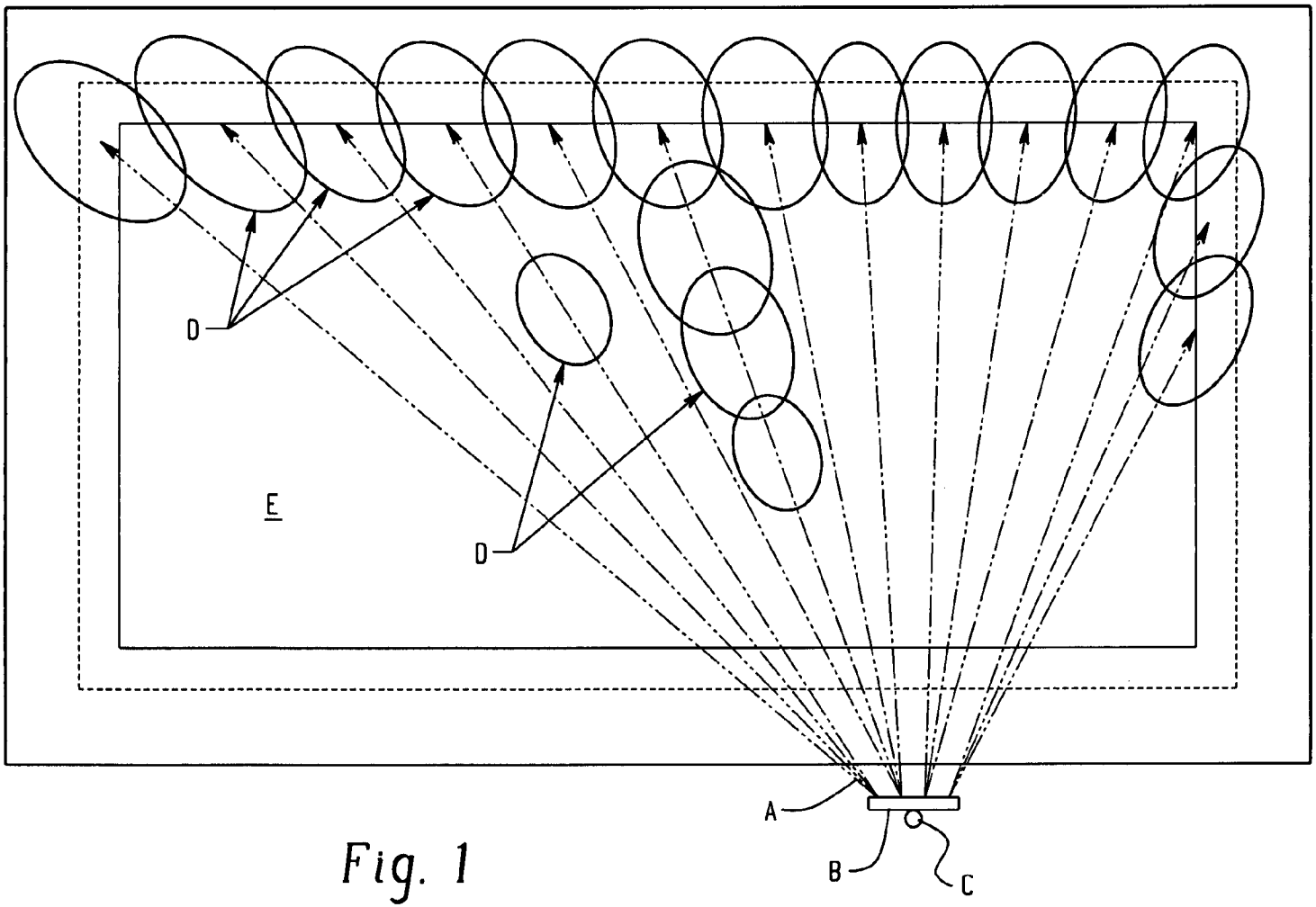
Fig. 1 PRIOR ART
FIG. 1 is a schematic of an existing sports/recreational field lighting system.
Figure 5:
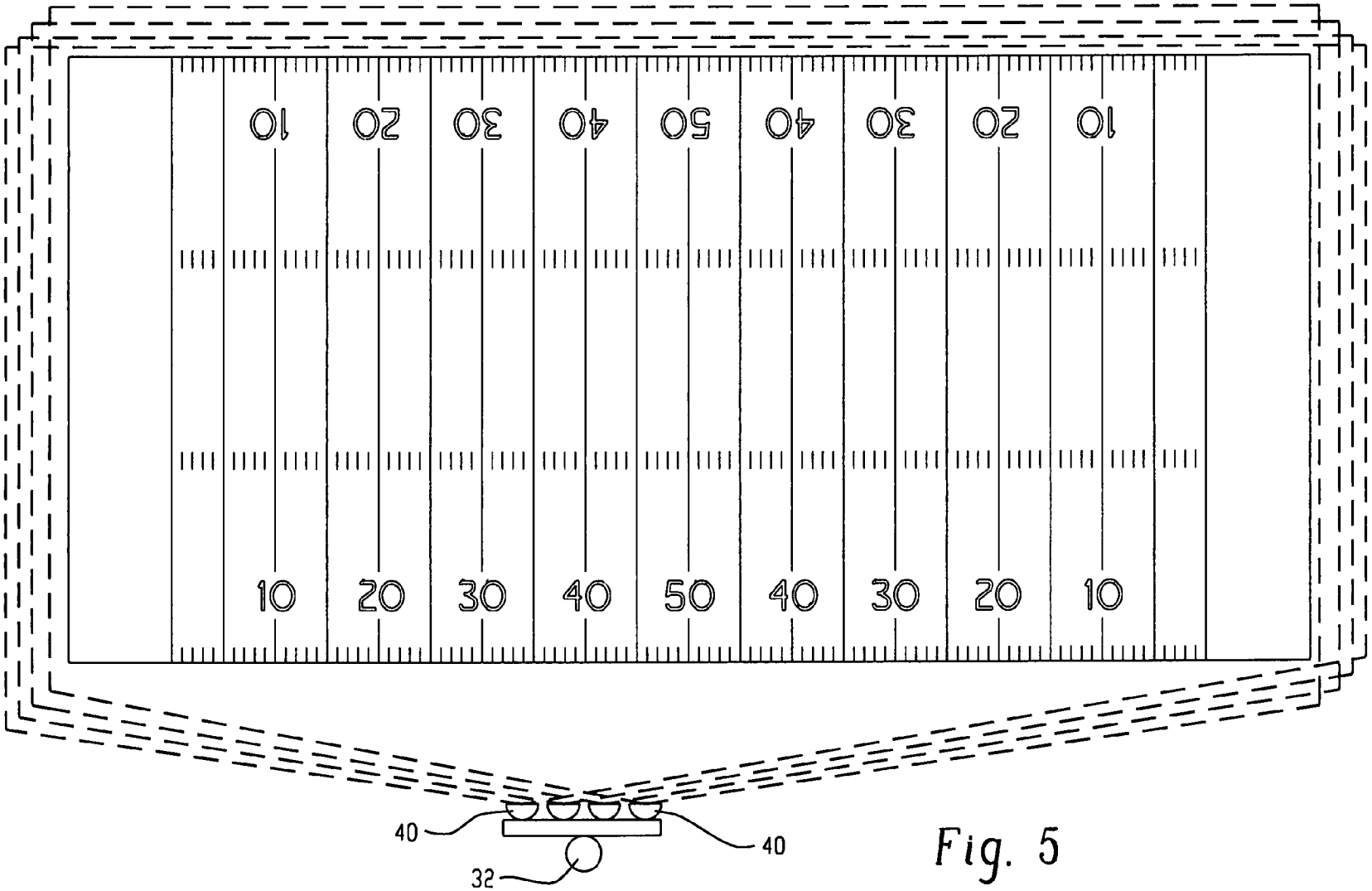
FIG. 5 is a schematic overhead view of beam patterns created by the lighting system on the field of FIG. 2.

As an example of a lighting system according to the present invention, in the embodiment depicted in FIG. 2, four light poles 32, 34, 36 and 38 are positioned roughly at the 25 yard line, which can equal a desired offset from the midfield line, of the football field 10 at a predetermined set back. Each pole includes a plurality of fixtures mounted at a predetermined height. Only fixtures 40 mounted to light pole 32 and some fixtures 42 mounted to light pole 34 are depicted. Each pole can include the same number of fixtures to ensure symmetric vertical light levels. With reference to FIG. 5, each fixture 40 of the light pole 32 is aimed at a target point and produces a beam spread such that it illuminates the entire playing field, including the area extending beyond the playing boundary. Thus, as will be appreciated from the illustration of FIG. 5, the photometric module of each fixture is designed so that the beam patterns substantially superpose, i.e. illuminate the entire field as opposed to simply lighting only a portion of the playing field, as depicted in FIG. 1.

Figure 7:
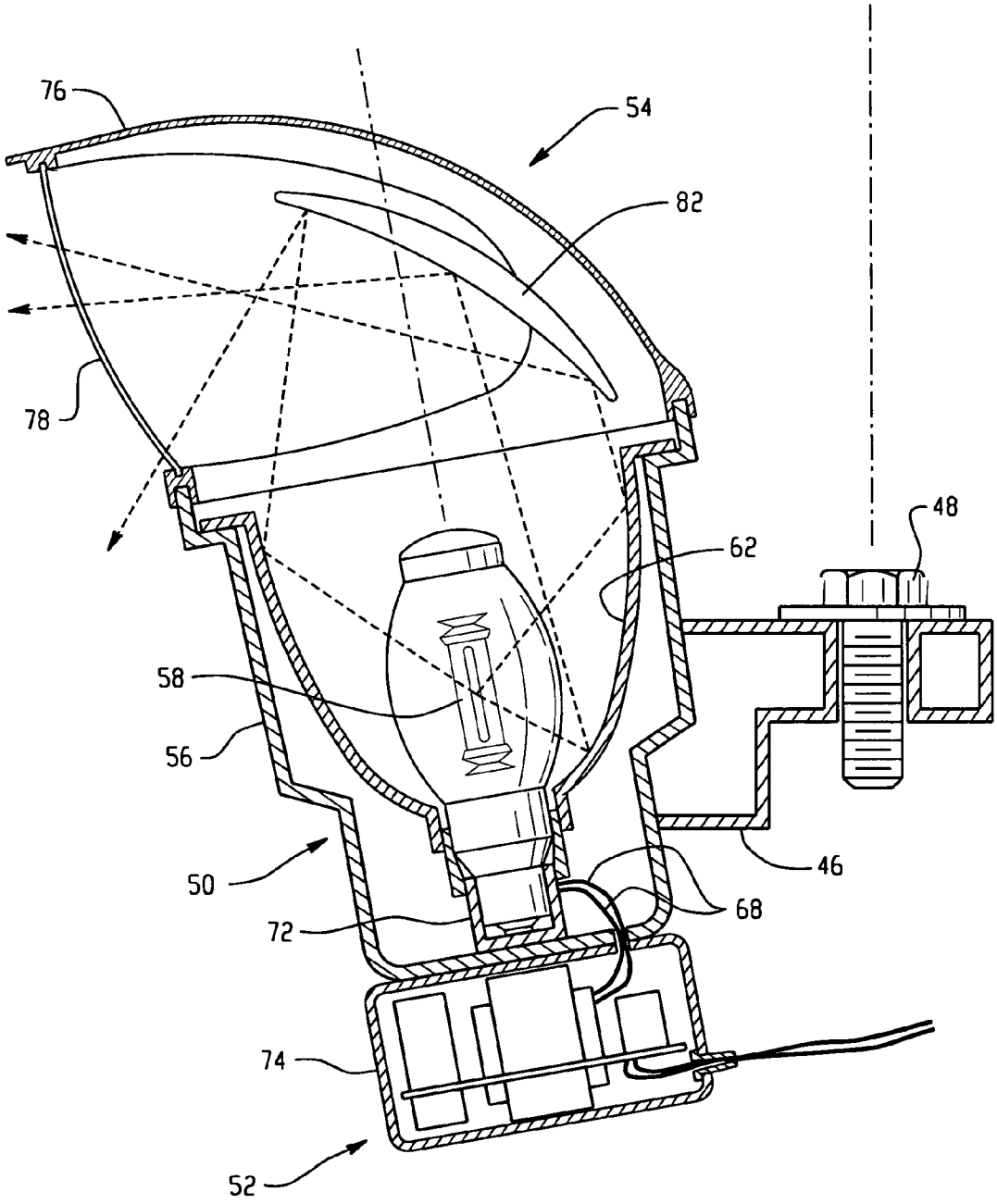
FIG. 7 is a side cross-sectional view of a fixture used in the lighting system of the present invention.

The light fixtures 40 mount to cross-arms 44, which mount to the light pole 32. In the embodiment of FIG. 2, each fixture 40 on the light pole 32 produces an identical photometric pattern that covers the entire playing area. Also, each fixture 40 is aimed in the same direction, and therefore at the same target point, taking into account the center to center spacing between the fixtures. Such a configuration reduces the complexity of lighting installation by eliminating fixture aiming. Thus, rather than encountering the laborious process of individually aiming each fixture, lighting uniformity and redundancy is already achieved across the entire playing field. Also, since each fixture 40 creates an identical photometric pattern and is generally aimed in the same direction, the light fixtures can attach to the cross-arm 44 using a mounting fixture that does not allow adjustment. For example, as depicted in FIG. 7 a fixed mounting arm 46 extends from the fixture 40 to attach to a cross-arm 44 (FIG. 2) using a bolt 48. The mounting arm 46 can be configured so that attachment to the cross-arm 44 results in proper aiming of the fixture. For example the notch shown in the mounting arm can cooperate with the cross-arm 44 to result in a desired aiming direction. In contrast, known mounting structures incorporate a rotatable knuckle or a rotatable trunnion configuration to allow for altitude and azimuth adjustment, which is not required with light fixtures 40 described herein.

Figure 6:
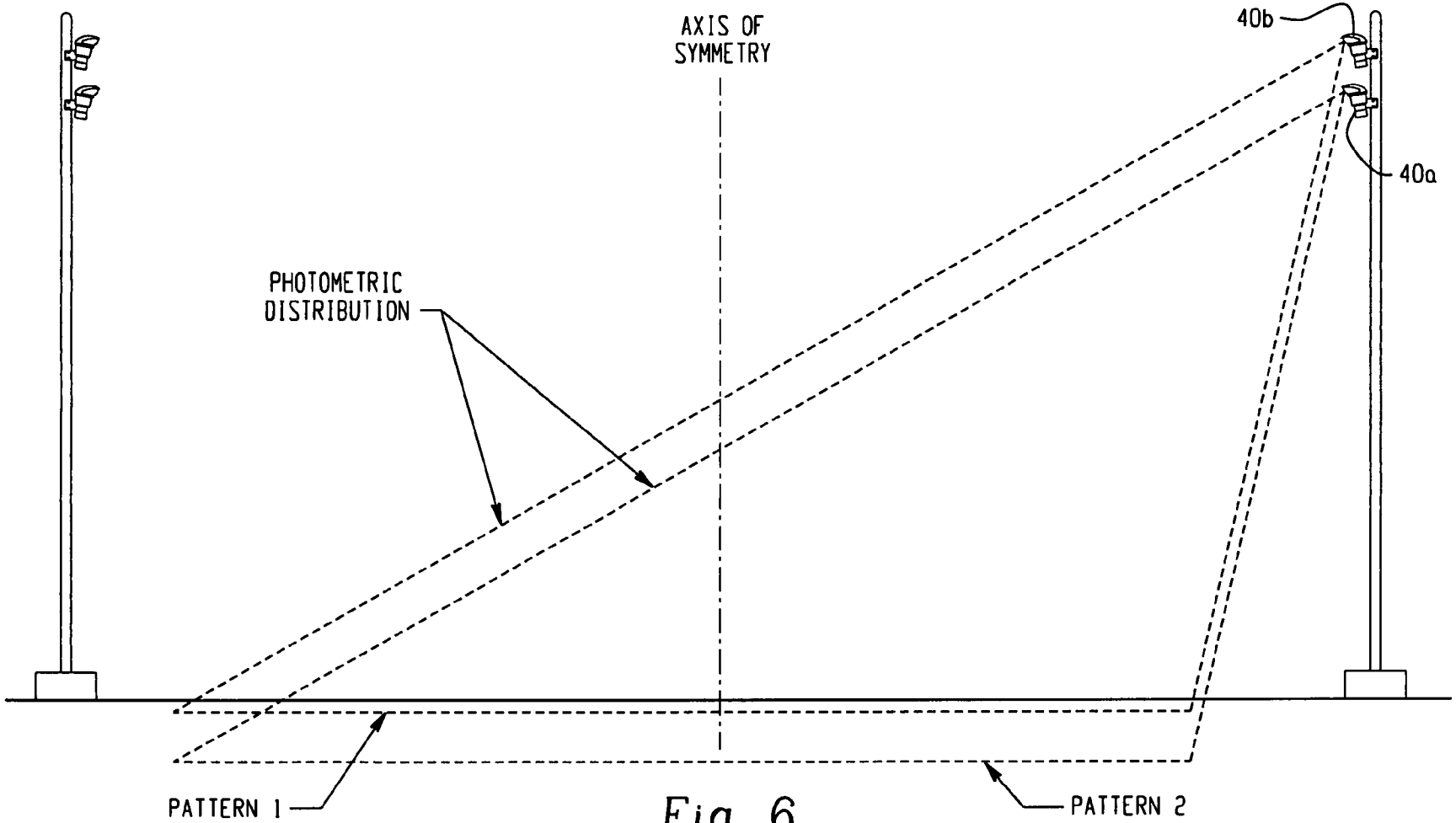
FIG. 6 is a schematic side view of beam patterns created by the lighting system on the field of FIG. 2 (beam patterns are offset vertically at the ground for clarity).

With reference to FIGS. 5 and 6, due to the fixture-to-fixture spacing in vertical and horizontal dimensions, the lighting patterns from each fixture, while covering the full field, have slight shifts relative to each other, taking into account the mounting displacement. As seen in FIGS. 5 and 6, the light pattern emitted from light fixture 40*a* has the same dimensions as the light pattern emitted from fixture 40*b*. The beam patterns are offset vertically at the ground in FIG. 6 simply for clarity. Due to the relatively large pole height, pole setback, and field size, the pattern-to-pattern shifts have relatively minimal influence on the lighting uniformity of the field.

Each light fixture creating a photometric pattern that covers the entire playing field also allows the light level produced on the field, i.e. the z-axis in FIGS. 3 and 4, to be scalable. Higher illuminance is achieved by simply adding additional fixtures. The converse holds true as well, in that the lighting system allows for redundancy where if one fixture goes out, the average light level of the entire field goes down, but the lighting uniformity stays the same. No dark spots result from a burned out fixture. To conserve energy many of the fixtures can be turned off, perhaps after the game, and the field is still lit at a lower average light level. This may be desirable for example, for security reasons where a limited number of fixtures are used to maintain a minimum level of light over the entire field. During periods when only low levels of light are required, which fixtures are used can be varied or alternated to extend the life of the fixtures and evenly spread the operating hours across all the lamps.

With reference back to FIG. 2, for an area to be lit having four-quadrant symmetry, such as the football field 10, fixtures situated on poles on opposite sides of the midfield line 18 produce a photometric pattern that are mirror images of one another. Accordingly, right-hand fixtures, e.g. fixtures 42, and left-hand fixtures, e.g. fixtures 40, are provided. Installation complexity is reduced by such a configuration in that all fixtures, i.e. both 40 and 42, all point in the same direction and mount in a fixed orientation to the arm or pole.

With reference to FIG. 7, the lighting fixture 40 or 42 includes a light engine 50, an electrical module 52, and a photometric module 54. The light engine 50 includes a housing 56 that encloses a lamp 58 and a reflector, or first reflector, 62. The lamp 58 in FIG. 7 is preferably either a jacketed or unjacketed high intensity gas discharge ("HID") lamp, however the lamp can comprise any lamp capable of producing the required amount of lumens. As opposed to known sports lighting systems where the arc tube axis generally points toward the field or where the arc tube is disposed horizontally with a side presented to the field, the arc tube axis of the lamp 58 can be situated nearly vertically, e.g., within 15 degrees of vertical orientation and nominally 10 degrees off vertical towards the field direction. The vertical configuration is because light is directed from the first reflector 62 toward the photometric module 54, which redirects light into a desired photometric beam.

Figure 8:
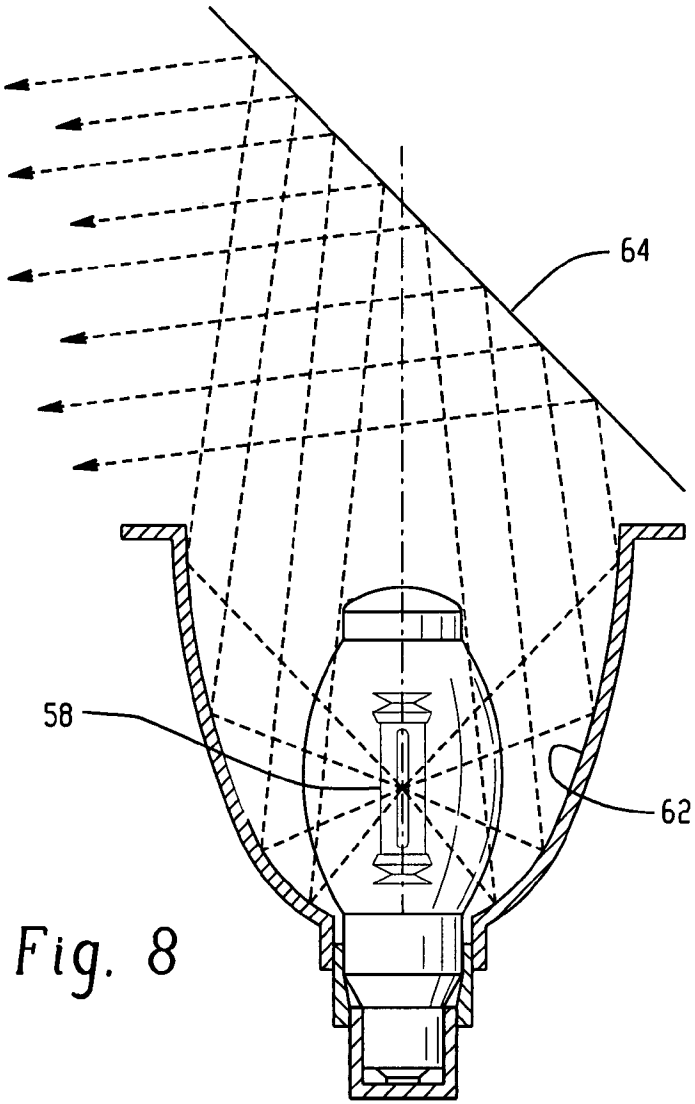
FIG. 8 is a side cross-sectional view of a portion of the fixture of FIG. 7 showing the path of light in the fixture.

With reference to FIG. 8, the first reflector 62 acts as a collector of the light emitted from the lamp and is shaped to create a converging beam with limited angular mixing of the light at a surface 64 generally where a reflective surface of distribution forming reflector, which will be described in more detail below, of the photometric module 54 resides. The first reflector 62 can have a concave upward shape and be positioned coaxial with the light source 58. The first reflector 62 is preferably a glass substrate having a high reflectivity (HR) coating such as multi-layer dielectric "cold mirror" type coating. The HR "cold mirror" coating for example, can reflect greater than 95% of the visible light and pass near-IR energy. The first reflector also has a short focal length and a high numerical aperture to maximize the light collection while minimizing the light engine size and weight. Effective focal lengths in the range of 1½ to four times the arc tube electrode gap can be employed.

With reference back to FIG. 7, the electrical module 52 mounts to the housing 56 of light engine 50 and appropriate electrical contacts 68 connect to a socket 72 that receives the base of the lamp 58. A mogul screw base lamp with a bulged tubular jacket BT is depicted for illustration, but other lamp basing methods are contemplated. These methods include a medium base, a bi-pin base, or a double ended lamp, as some examples. The electrical module 52 attaches to the housing 56 of the light engine 50 in a variety of ways including, but not limited to, flanges and screws, shoulders and set screws, ¼ turn threads, bayonet or twist lock mechanisms, toggle clamps, or any variety of compatible conventional mechanical means. The electrical module attaches and detaches easily to the light engine to facilitate assembling and upgrading the fixture. The electrical module 52 includes a housing 74, enclosing typical electrical components such as a magnetic ballast, a capacitor, wiring and starting elements, and interconnects to create the module-to-module and fixture-to-pole electrical connections (not shown). Component location and component mounting methods within the module are designed to maximize the heat transfer efficiency and reduce the operating temperatures of the most sensitive components such as the capacitor. The electrical module is not limited to conventional magnetic ballast components and may alternatively include an electronic ballast. Alternatively, the active electrical components, i.e., a magnetic or electronic ballast, can be mounted in a remote location and the fixture can include a cabling adapter module to electrically connect to the remote ballast.

The photometric module 54 mounts to the housing 56 of the light engine 50. The photometric module 54 includes a housing 76, an output window 78, and a distribution forming reflector 82. The photometric module can also include light shields to control spill light or glare. The distribution forming reflector, or second reflector, 82 redirects converging light from the first reflector 62 to form a photometric beam shape designed to uniformly illuminate the desired area to be illuminated. The distribution forming reflector 82 can be made of a pressed glass material and coated with an HR "cold mirror" coating. The distribution forming reflector 82 can be made from other known materials with a high reflectivity specular finish. The photometric module housing 76 mounts to the light engine housing 56 in a similar fashion to the electronic module housing 74 mounting to the light engine housing. The output window 78 serves to enclose the fixture's optical components and is preferably made of pressed or sagged glass and includes single or multilayer anti-reflection (AR) coating for visible wavelengths on interior and/or exterior surfaces of the output window. Dependent upon such factors as the setback of the fixture from the area to be lit (i.e. the football field), the vertical height of the fixture on the light pole, and the surface area of the field including the area to be lit outside the field boundaries, the shape of the photometric distribution forming reflector 82 is determined. Computer modeling, for example using iterations, determines the shape of the distribution forming reflector 82. For many applications, the distribution forming reflector 82 will adopt a toric-like shape being generally concave in the vertical dimension and generally convex in the horizontal dimension with horizontal and vertical asymmetries related to the energy distributions required along those directions. The shape of the distribution forming reflector 82 can be determined using a process depicted in FIG. 9.

Figure 9A:
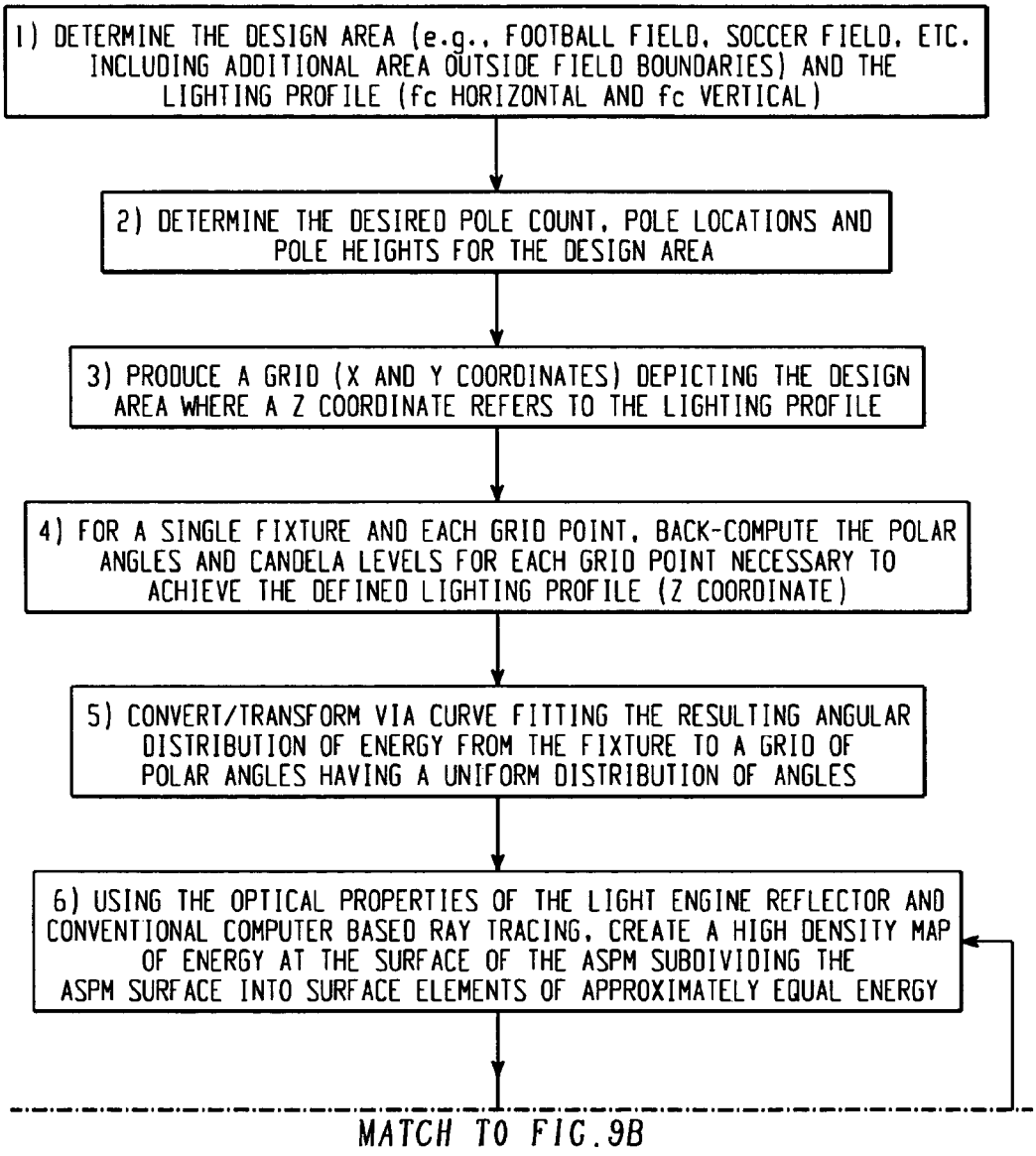
FIGS. 9A and 9B are flow-charts depicting a process for determining the shape of a photometric module.
Figure 9B:
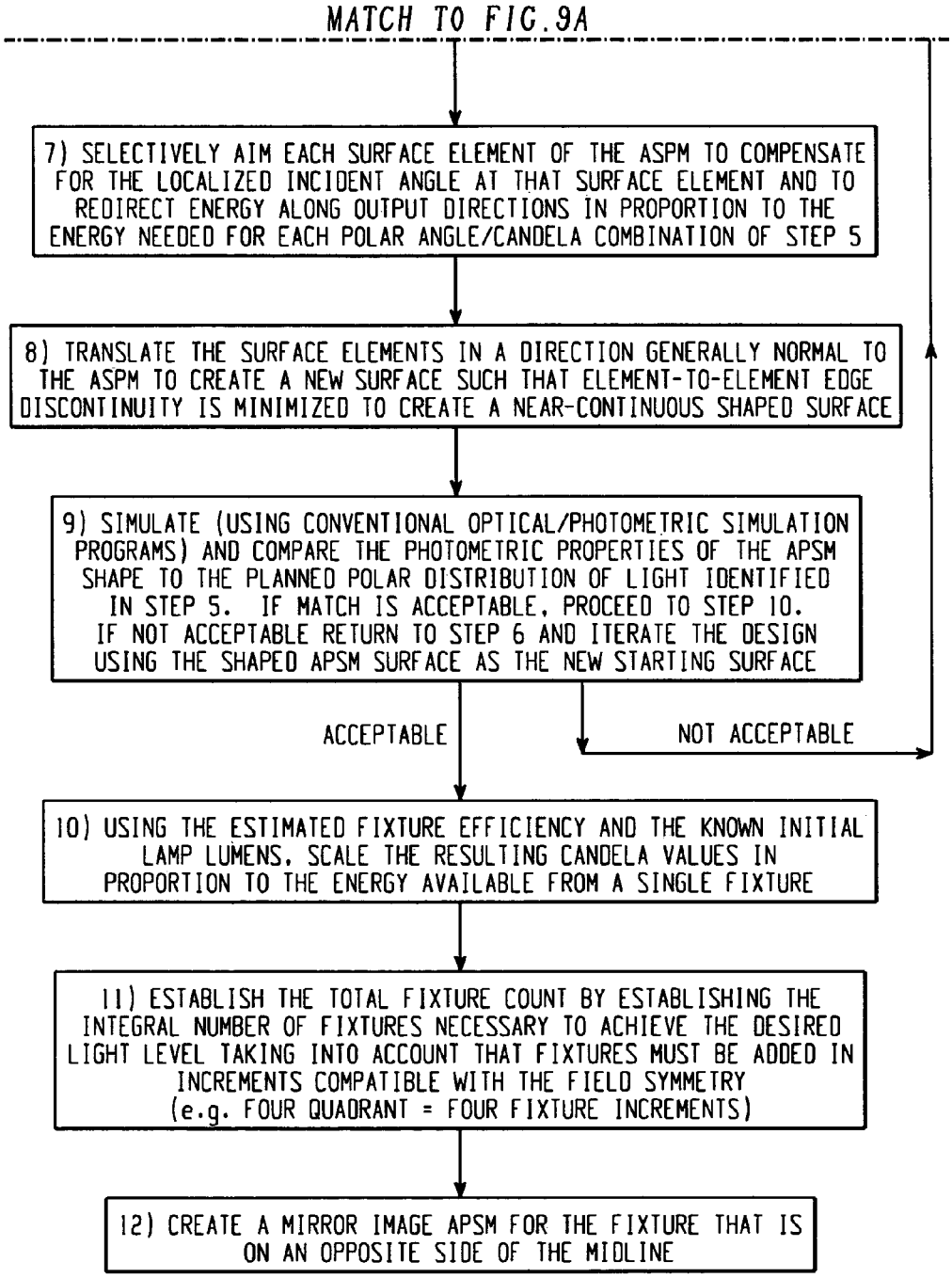

FIG. 9 depicts the process in a numerical order; however, some of the steps can be performed before or simultaneously with other steps and the order of the process should not be limited to being practiced in any particular order unless otherwise indicated. Also, the process depicted is for use mainly with outdoor, four-quadrant symmetrical fields, but the process can easily be tailored for indoor applications and other outdoor applications. For example, the location of the lights can be determined without the lights being mounted on poles. Also, the process may recite specific manners of performing steps, for example converting or transforming via curve fitting. Where specific steps are recited it is intended to also include the more generic or other methods for performing the steps. For example, step 5 can also use interpolation instead of curve fitting. Other similar methods for performing the steps depicted in FIG. 9 will come to those skilled in the art and should be included as part of the description.

Figure 10:
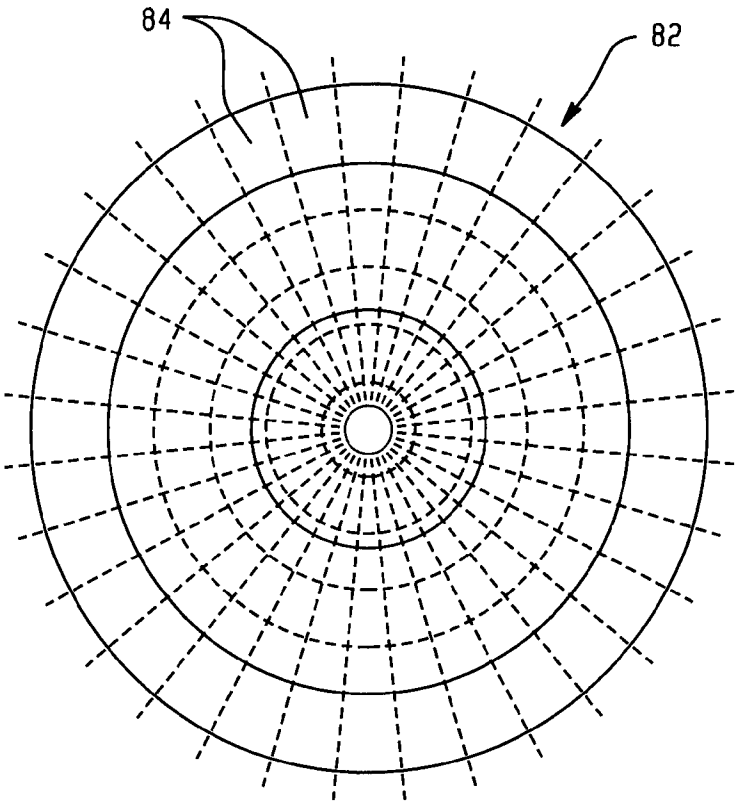
FIG. 10 is a plan view of a starting surface of the photometric module in the process for determining the shape of the photometric module.

FIG. 10 depicts the surface of the distribution forming reflector 82 as described in step 6 of FIG. 9 where the surface is divided into a plurality of surface elements 84 of approximately equal energy. These surface elements 74 can be individually aimed and reshaped with respect to one another to form a reflecting surface for the reflector 82.

Figure 11:
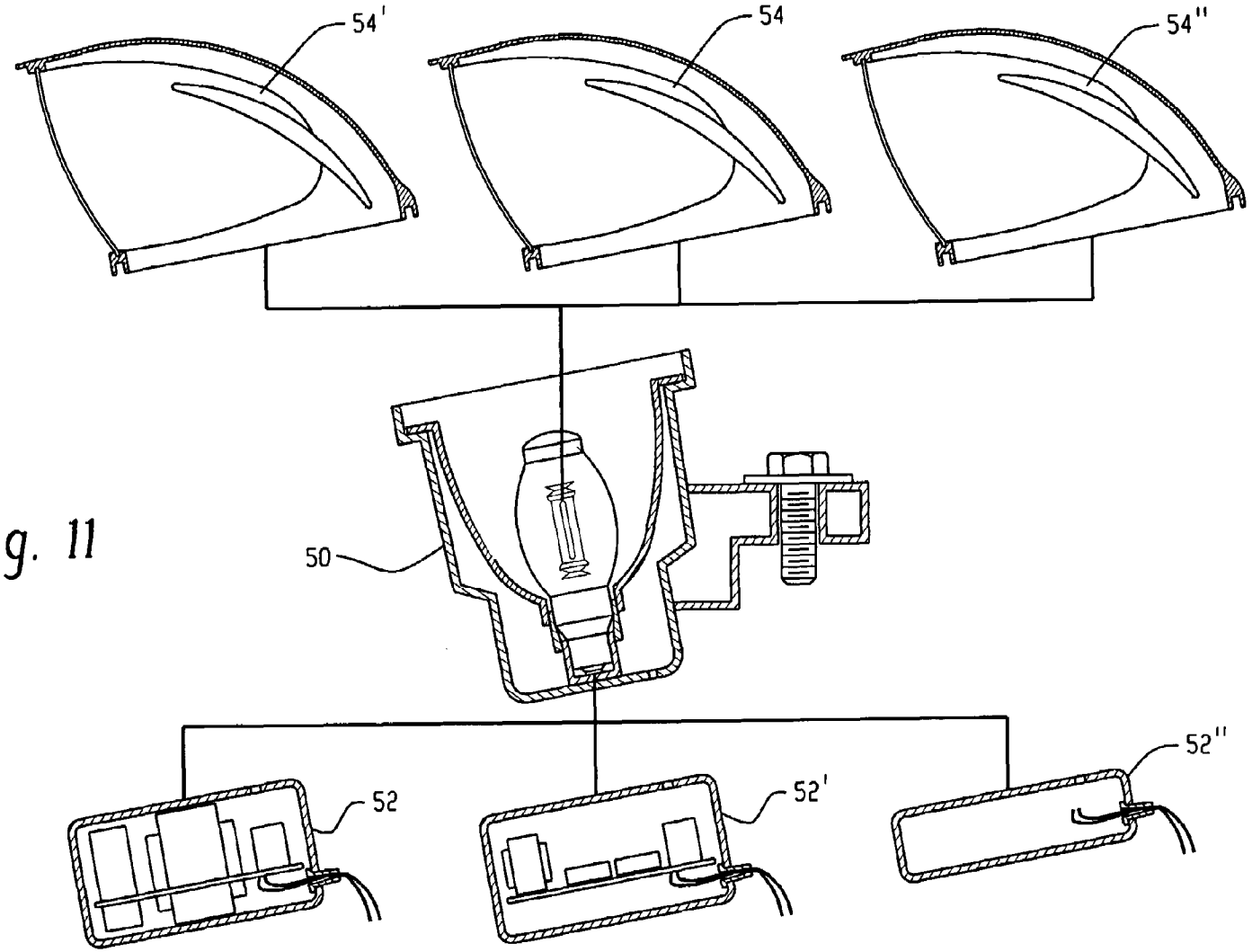
FIG. 11 is an exploded view of the fixture of FIG. 7 and illustrating the ability to substitute different electronic modules and photometric modules.

The shape and design of the distribution forming reflector 82 is dependent upon the application. With reference to FIG. 11, different photometric modules, i.e., application specific photometric modules ("ASPM"), are used for different applications. FIG. 11 depicts the modular construction of the light fixture 40, where like components are depicted with like numerals having a primed (') suffix or a double-primed (") suffix. For example, a photometric module 54' can be designed for a playing field having two light poles, a photometric module 54 can be designed for a playing field having four poles, or a photometric module 54" can be designed for a specific type of field such as a baseball field having four poles to name just a few. Application specific photometric modules can be developed to numerous other applications as well. This modular approach to manufacturing the fixtures simplifies production to reduce the overall cost of the lighting system. The ASPMs also allow easy future upgrades by simply replacing the ASPM of an existing fixture with a new ASPM.

The combination of vertical lamp 58, HR and AR optical coatings, and lamp optimized for pulse arc and vertical operation is believed to yield overall efficiency that would allow a 1000 W lamp to do the job normally done by a 1500 W lamp in conventional fixtures. This is a large lifetime operating cost advantage compared to conventional fixtures and reduces the cost of electrical infrastructure due to reduced peak load. The vertical closed cylinder form factor of the fixture, and expected reduced diameter of the fixture combined with the inherent shielding and photometric properties is believed to result in a reduction in EPA (effective projected area), which is the fixture's effective size for wind loading issues, of roughly a factor of 2 compared to conventional fixtures providing comparable shielding performance. Also, smaller fixture diameter and fixed aiming is believed to allow closer fixture spacing and reduced structure size. This has significant advantages in reducing the cost of infrastructure such as poles, foundations, and cross arms or facilitating novel cross arm forms. The use of a vertical lamp of lower wattage enables the use of an arc tube/wattage combination with shorter arc gap and lower arc tube wall power/heat loading. The lower wall loading results in the potential for a two-fold increase in expected operating life of the lamp and a proportional reduction in associated lamp replacement and service costs such as bucket truck rental, etc. The shorter arc gap allows the optical system to be smaller overall by allowing shorter focal lengths to achieve the same definition in the beam forming required to cover the full field and properly address light throw to the corners of the distribution.

Figure 12:
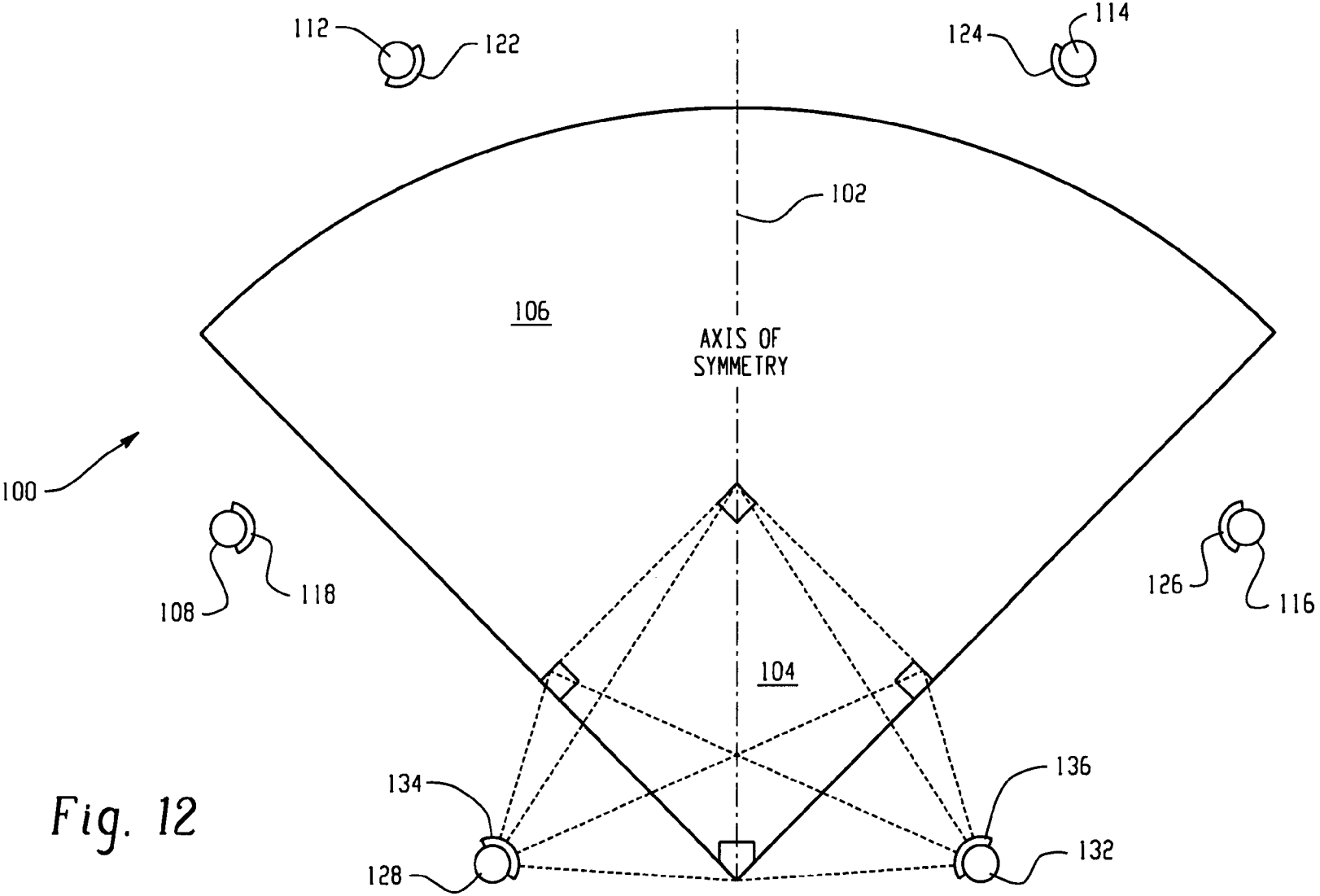
FIG. 12 is a schematic view of a baseball field to be lighted by the lighting system according to the present invention.

In addition to lighting an area having a four-quadrant symmetrical configuration, the present invention can also be used to light areas with less symmetry. For example in FIG. 12, a baseball field 100 usually includes a line of symmetry 102 bisecting home plate, the pitching rubber, and second base. A baseball field typically requires a higher lighting level in the infield 104 than in the outfield 106. Thus, poles 108, 112, 114 and 116 each include a plurality of light fixtures 118, 122, 124 and 126, respectively. The light fixtures 118, 122, 124 and 126 provide uniform lighting of the entire field at typical outfield levels. Each light fixture includes a photometric module that is adapted to create a light beam pattern that covers the entire field including portions outside the boundaries of play. Poles 128 and 132 also each include a plurality of light fixtures 134 and 136 respectively. The light fixtures 134 and 136 provide additional light to the infield 104 only to increase the level of light to desired infield levels. Since the light levels are scalable, and because each fixture covers an entire designated area, the light level that is delivered by fixtures 118, 122, 124 and 126 is simply increased by the light delivered by fixtures 134 and 136.

Furthermore, to simplify installation, light fixtures 134 can be a mirror image of light fixtures 136. Likewise light fixtures 118 can be a mirror image of light fixtures 126 and light fixtures 122 can be a mirror image of light fixtures 124. This, too, simplifies manufacture and assembly.

Figure 13:
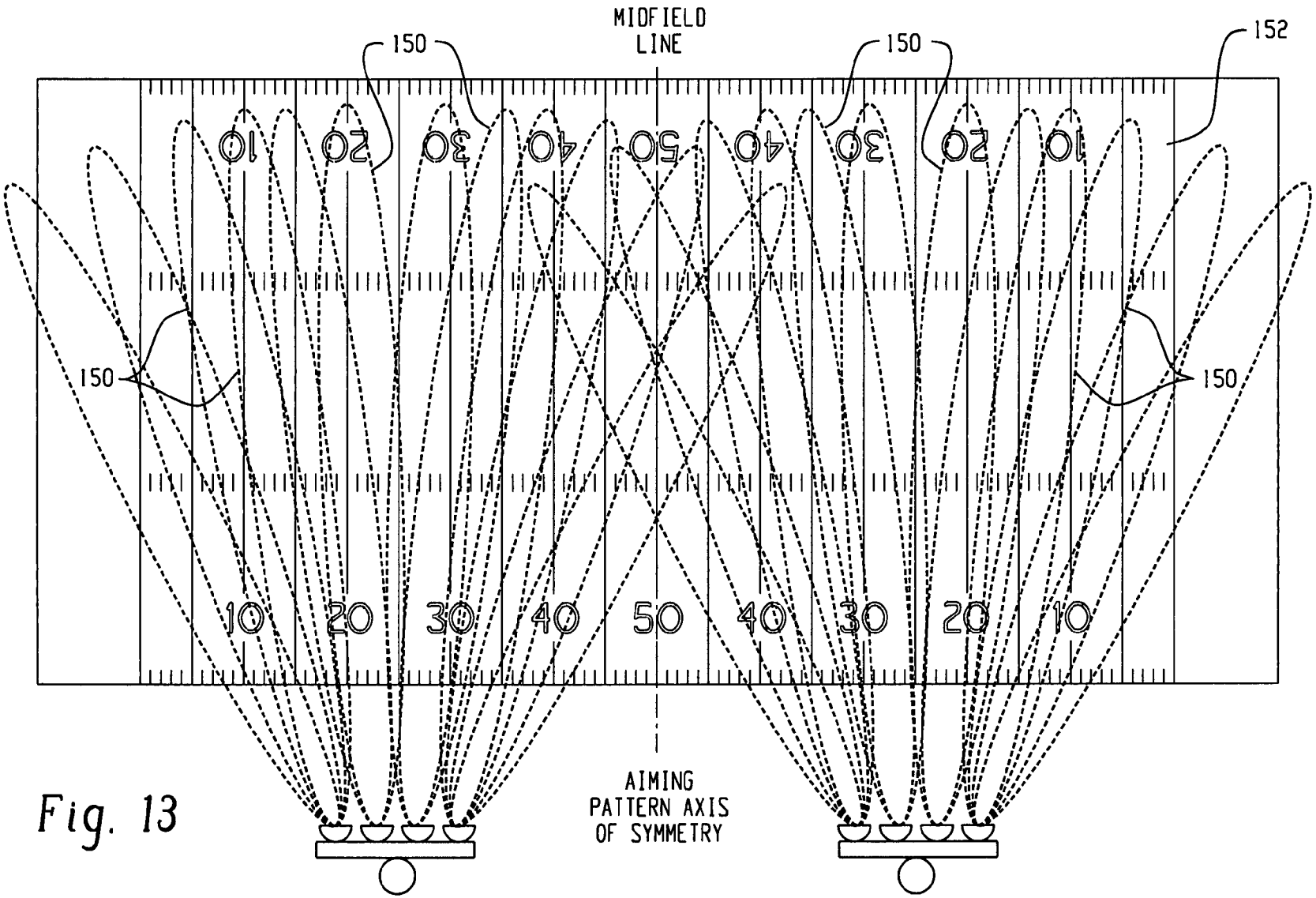
FIG. 13 is a schematic overhead view of beam patterns created by an alternative embodiment of a lighting system according to the present invention.

An alternative lighting system based on the photometric capability of the fixture described above can be provided that would require less aiming than conventional sports lighting systems. In this system, as shown in FIG. 13, ASPMs can be designed to create a photometric beam 150 that covers the full width of a football field 152, or other area to be lighted, but the beam 150 does not cover the entire length of the football field. Accordingly, a fixture employing such an ASPM could attach to a pole and be adjustable in only one axis to provide fixed altitude aiming and variable azimuth aiming. Alternatively, an ASPM can be designed to create a photometric beam that covers the full length of the area to be illuminated, e.g., a football field, that does not cover the entire width. In such a case the light fixture employing the ASPM mounts to a light pole in such a manner to allow for variable altitude aiming while having a fixed azimuth aiming.

While specific embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A method of providing redundancy when illuminating a subject area with a plurality of light sources where the subject area has a desired lighting criteria, the method comprising the steps of:

providing a first light source having a first photometric module;

directing light emitted from the first light source to illuminate the subject area;

providing an additional light source having an additional photometric module;

directing light emitted from the additional light source to illuminate the subject area; and repeating the previous two steps until the lighting criteria are met;

wherein for each of the directing steps the subject area comprises an area from the group consisting of substantially the entirety of a football field, a baseball field, a softball field, a soccer field, a recreation field, an arena floor, a tennis court, an exercise floor, a gymnasium floor, a parking lot, and combinations thereof.

2. The method of claim 1, wherein for each of the providing steps the additional photometric module is substantially identical to the first photometric module.

3. The method of claim 1, further comprising:

aiming the first light source toward a target point; and aiming each additional light source substantially toward a point offset from the target point by a dimension that corresponds to center to center spacing between the additional light source and the first light source.

4. The method of claim 3, further comprising alternating which light source illuminates the subject area.

5. The method of claim 1, wherein for the providing a first light source step, the first light source mounts to a first light pole, and wherein for the providing an additional light source step, the additional light source mounts to an additional light pole, further comprising the steps of:

aiming the first light source toward a target point; and aiming the additional light source toward the target point.

6. The method of claim 1, wherein the providing an additional light source step comprises the additional light source having a photometric module that creates a photometric beam that is the mirror image of a photometric beam created by the first photometric module.

7. A method of providing illumination of an associated subject area, the method comprising the steps of:

providing a housing fixture;

a lamp disposed in the fixture housing;

providing a first reflector shaped and positioned with respect to the lamp such that the reflector collects light emitted from the lamp to create a converging beam with limited angular mixing at a surface that is located a predetermined distance from the lamp;

providing a photometric module connected to the housing and including a second reflector, wherein the second reflector is shaped and positioned with respect to the first reflector such that the photometric module generates a photometric beam shape that substantially uniformly illuminates a full width of the associated subject area, wherein the associated subject area comprises an area from the group consisting of a football field, a soccer field, a recreation field, an arena floor, a tennis court and a gymnasium floor.

8. The assembly of claim 7, wherein the lamp comprises an arc tube axis that is at least within 15 degrees of vertical.

9. The assembly of claim 8, wherein the first reflector comprises a concave upward reflector coaxial with the arc tube axis.

10. The assembly of claim 7, wherein the second reflector is shaped and positioned with respect to the first reflector to generate a photometric beam shape that uniformly illuminates the full length of the subject area.

* * * * *